US011759667B2

(12) United States Patent
Lin

(10) Patent No.: US 11,759,667 B2
(45) Date of Patent: Sep. 19, 2023

(54) RECIPROCATING UNIDIRECTIONAL ELECTROMAGNETIC RESISTANCE DEVICE

(71) Applicant: Yen-Chao Lin, Taipei (TW)

(72) Inventor: Yen-Chao Lin, Taipei (TW)

( * ) Notice: Subject to any disclaimer, the term of this patent is extended or adjusted under 35 U.S.C. 154(b) by 157 days.

(21) Appl. No.: 17/408,539

(22) Filed: Aug. 23, 2021

(65) Prior Publication Data

US 2023/0053751 A1 Feb. 23, 2023

(51) Int. Cl.

| | |
|---|---|
| ***A63B 21/005*** | (2006.01) |
| ***A63B 21/22*** | (2006.01) |
| ***A63B 21/00*** | (2006.01) |
| ***A63B 24/00*** | (2006.01) |

(52) U.S. Cl.

CPC ..... *A63B 21/0056* (2013.01); *A63B 21/153* (2013.01); *A63B 21/157* (2013.01); *A63B 21/225* (2013.01); *A63B 24/0062* (2013.01); *A63B 2220/35* (2013.01); *A63B 2220/833* (2013.01)

(58) Field of Classification Search

CPC ..... A63B 21/0056; A63B 21/0057; A63B 21/0058; A63B 21/153; A63B 21/154; A63B 21/157; A63B 21/22; A63B 21/222; A63B 21/225; A63B 2220/34; A63B 2220/35; A63B 2220/833

See application file for complete search history.

(56) References Cited

U.S. PATENT DOCUMENTS

| | | | | |
|---|---|---|---|---|
| 3,848,467 | A * | 11/1974 | Flavell | A63B 21/153 482/4 |
| 4,184,678 | A * | 1/1980 | Flavell | A63B 21/153 482/901 |
| 4,261,562 | A * | 4/1981 | Flavell | A63B 21/0053 482/6 |
| 5,409,435 | A * | 4/1995 | Daniels | F16D 57/002 482/901 |
| 5,916,069 | A * | 6/1999 | Wang | A63B 21/153 482/57 |
| 7,732,961 | B2 * | 6/2010 | Lin | H02K 1/16 310/74 |
| 8,957,641 | B1 * | 2/2015 | Hsu | A63B 24/0087 322/4 |
| 9,662,534 | B1 * | 5/2017 | Liu | A63B 21/0051 |
| 9,687,689 | B2 * | 6/2017 | Lin | A63B 23/14 |

(Continued)

*Primary Examiner* — Sundhara M Ganesan
*Assistant Examiner* — Zachary T Moore

(57) ABSTRACT

A reciprocating unidirectional electromagnetic resistance device includes a shaft having a flywheel installed to a first end of the shaft, an electromagnetic braking unit, and a first sensing device. A spring return device and a second sensing device are installed at a second end of the shaft, and a pull rope device is installed at the middle of the shaft. The electromagnetic braking unit and the spring return device are integrated into a single module and provided for an operator to perform a reciprocating motion to pull out a pull rope of the pull rope device and drive the shaft, the flywheel and the spring return device synchronously, and the electromagnetic braking unit acts an electromagnetic resistance onto the flywheel, so that the flywheel has the excellent precise resistance of the electromagnetic braking unit. When released, the pull rope can be retracted to achieve the reciprocating motion effect.

13 Claims, 10 Drawing Sheets

(56) References Cited

U.S. PATENT DOCUMENTS

| | | | | |
|---|---|---|---|---|
| 11,173,343 | B2 * | 11/2021 | Lee | A63B 24/0087 |
| 11,364,404 | B2 * | 6/2022 | Hsu | A63B 21/00069 |
| 2009/0036276 | A1 * | 2/2009 | Loach | A63B 21/15<br>482/72 |
| 2011/0227514 | A1 * | 9/2011 | Lee | H02P 3/04<br>318/376 |
| 2014/0038777 | A1 * | 2/2014 | Bird | A63B 23/03525<br>482/5 |
| 2015/0057130 | A1 * | 2/2015 | Lin | A63B 21/225<br>482/72 |
| 2020/0023232 | A1 * | 1/2020 | French | A63B 21/225 |
| 2021/0353994 | A1 * | 11/2021 | Paz Domonte | A63B 21/15 |

* cited by examiner

RECIPROCATING UNIDIRECTIONAL ELECTROMAGNETIC RESISTANCE DEVICE

BACKGROUND OF THE INVENTION

Field of the Invention

The present invention relates to an electromagnetic resistance device, in particular to a reciprocating unidirectional electromagnetic resistance device applied to fitness equipment.

Description of Related Art

In recent years, the rise of fitness trends has led to the prosperous development of related fitness equipment. Fitness is roughly divided into cardio exercises and strength training. Since the strength training can sculpt our body significantly, the demand and fineness of such exercises have increased gradually in this decade. However, the strength-training devices, such as a dumbbell, a barbell and a heavy weight training machine, generally uses the gravity produced by a weight to achieve the resistance effect, in addition to the use of the simple horizontal bar, spring, and elastic rope/belt, etc. with user's gravity or the resistance of an elastic body to achieve the effect of fitness.

Although the foregoing equipment can achieve the required resistance effect, it still has defects on the quantification of training data. In recent years, there have been a number of designs using a motor as a main resistance system, which can overcome the issue of data quantification issue and the request for precise control, but the active driving feature of these designs requires many precise sensors and has a safety concern when the sensor is damaged to cause malfunction, so that such equipment has to add more protective device to deal with the safety issue of the equipment.

Magnetoresistive systems, from the early-stage mechanical magnetoresistive systems to the recent electrical magnetoresistive systems with high safety and stability have already been widely used and accepted by users and market. However, the conventional magnetoresistive systems are of a passively driven structure. If a user does not operate the equipment, the equipment will not operate initiatively. Although the safety is very high, the magnetoresistive system cannot achieve the requirements for related actions since the operation of an strength training relates to a reciprocating motion, and this problem still remains as a difficult issue of the prior art, which is also a main topic for the present invention to overcome.

SUMMARY OF THE INVENTION

Therefore, it is a primary objective of the present invention to provide a reciprocating unidirectional electromagnetic resistance device that integrates an electromagnetic braking unit and a spring return device into a single module, such that reciprocating unidirectional electromagnetic resistance device has the precise resistance feature of electromagnetic braking unit while rewinding the pull rope to achieve the reciprocating motion effect.

To achieve the aforementioned and other objectives, the present invention discloses a preferred technical solution of the reciprocating unidirectional electromagnetic resistance device, comprising: a shaft and a flywheel, and the flywheel has a hub rotatably coupled to the shaft; an outer ring body and the hub coaxially disposed around the periphery of the hub; a plurality of spokes, each coupled between the hub and the outer ring body; a one-way clutch, with an inner ring surface sheathed on a first end of the shaft, and the hub being sheathed and coupled to an outer ring surface of the one-way clutch; an electromagnetic braking unit, having a toroidal core, a plurality of serrated portions formed at an outer ring of the toroidal core, and a plurality of coils wound around the serrated portions respectively; the electromagnetic braking unit being installed between the hub and the outer ring body of the flywheel, and the serrated portion being configured to be facing an inner ring surface of the outer ring body to produce an electromagnetic resistance; a pull rope device, having a winding wheel fixed to the shaft, and a pull rope with an end coupled to the winding wheel for pulling the winding wheel and the shaft, and the shaft and the one-way clutch driving the flywheel to rotate unidirectionally; and a spring return device, coupled to the shaft or the winding wheel, for driving the winding wheel to rewind the pulled-out pull rope.

Through the application of the above technical measures, the present invention overcomes the safety issue of the active driving operation of the conventional motor and uses the method with the passive driving principle of magnetoresistance to assist a precise control and achieve the effects of greatly reducing the degree of dependence on sensors, satisfying the requirement for accuracy, and providing the data quantification, high-accuracy and safety functions.

In a preferred embodiment, the reciprocating unidirectional electromagnetic resistance device further comprises a first sensing device, having a turntable coupled to an end surface of the flywheel and rotated synchronously with the flywheel; and a first sensing module configured to be facing the turntable to sense the rotating speed of the turntable.

In a preferred embodiment, the reciprocating unidirectional electromagnetic resistance device further comprises a second sensing device coupled to the shaft for sensing the rotating speed of the winding wheel when the winding wheel is driven to rotate.

In a preferred embodiment of the reciprocating unidirectional electromagnetic resistance device, the flywheel is installed at the first end of the shaft, and the spring return device is installed at a second end of the shaft, and the winding wheel of the pull rope device is sheathed and fixed between the flywheel and the shaft of the spring return device to achieve the dynamic balance effect at both ends of the shaft of the electromagnetic resistance device.

In a preferred embodiment of the reciprocating unidirectional electromagnetic resistance device, the winding wheel of the pull rope device is sheathed and fixed to the first end of the shaft, and the spring return device is installed to the second end of the shaft, and the flywheel is installed on the shaft between the pull rope device and the spring return device to install the flywheel at the middle of the shaft, so as to achieve the dynamic balance effect.

In a preferred embodiment, the reciprocating unidirectional electromagnetic resistance device further comprises a bracket having two plates, and the shaft rotatably passes through the two plates, so that both ends of the shaft are protruded from both sides of the bracket; and the flywheel, the electromagnetic braking unit and the first sensing device are disposed at the first end of the shaft on one side, and the spring return device and the second sensing device are disposed at the second end of the shaft on the other side, and the pull rope device is disposed on the shaft between the two plates, so as to achieve the effect of facilitating the assembling process and the future maintenance of the flywheel, the electromagnetic braking unit, the spring return device and the first and second sensing devices.

In a preferred embodiment of the reciprocating unidirectional electromagnetic resistance device, the pull rope device is sheathed and fixed to the first end of the shaft, and the spring return device is installed to the second end of the shaft on the second side of the bracket, and the flywheel, the electromagnetic braking unit and the first sensing device are disposed on the shaft between the two plates.

In a preferred embodiment of the reciprocating unidirectional electromagnetic resistance device, the bracket has two bearing seats and two ball bearings, and the two bearing seats are coupled to two through holes of the two plates respectively, and the two ball bearings are disposed in the bearing seats respectively; and the shaft is passed and installed to the two ball bearings in the two bearing seats, so as to achieve the effect of facilitating future replacement and maintenance of the bearing seat and the ball bearing, and the structure of the present invention is easy to install and apply to a bracket or a machine body of the fitness equipment.

In a preferred embodiment of the reciprocating unidirectional electromagnetic resistance device, the turntable of the first sensing device is fixed onto the hub of the flywheel and disposed adjacent to a first bearing seat of the two bearing seats, and the first sensing module is fixed onto the first bearing seat to achieve the effect of accurate sensing the rotating status of the flywheel.

In a preferred embodiment of the reciprocating unidirectional electromagnetic resistance device, the first bearing seat has a flanged ring with a plurality of screw holes; the toroidal core of the electromagnetic braking unit has a plurality of screw perforations configured to be corresponsive to the screw holes respectively, and a plurality of screws passed through the screw perforations and locked to the screw holes respectively, and the toroidal core is fixed to a side of the flanged ring to achieve the effects of changing the magnetic resistance of the electromagnetic braking unit and the flywheel without changing other components according to the type of fitness equipment.

In a preferred embodiment of the reciprocating unidirectional electromagnetic resistance device, the spring return device has a shell with an end coupled to the plate, and a scroll spring installed in the shell and wound around the shaft, and an inner end of the scroll spring is fixed to the shaft, and an outer end of the scroll spring is fixed to the shell to achieve the effect of protecting the scroll spring by the shell.

In a preferred embodiment of the reciprocating unidirectional electromagnetic resistance device, the second sensing device comprises a sensed element and a second sensing module, and the sensed element is fixed to an end surface of the shaft, and the second sensing module is fixed to the shell, and the second sensing module is configured to be facing the sensed element to sense the rotating speed of the sensed element and the shaft and achieve the effect of assembling the second sensing module and the spring return device into a modular component.

DESCRIPTION OF THE PREFERRED EMBODIMENTS

The aforementioned and other objects, characteristics and advantages of the present invention will become apparent with the detailed description of the preferred embodiments and the illustration of related drawings as follows.

Figure 1:
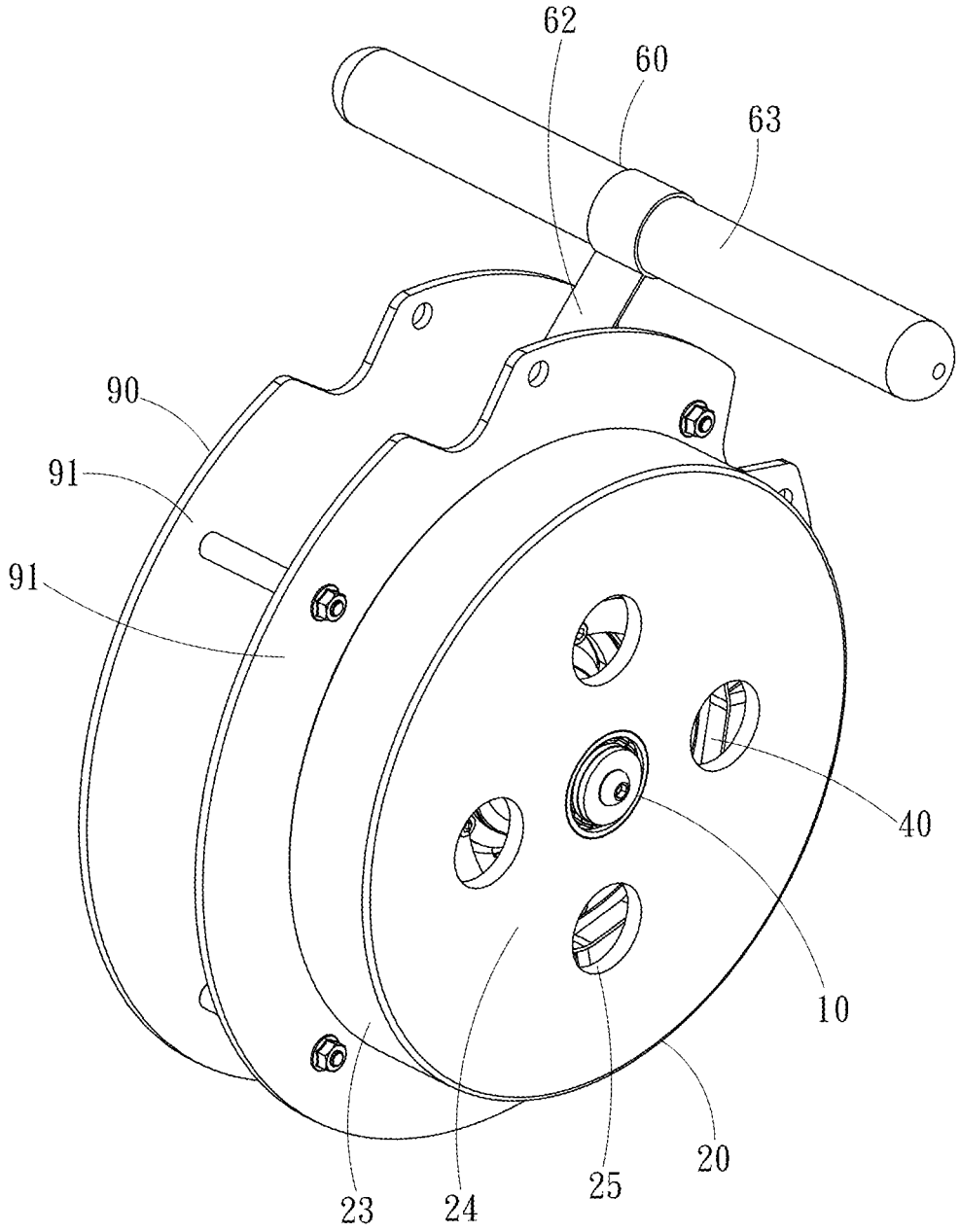
FIG. 1 is a perspective view of a reciprocating unidirectional electromagnetic resistance device in accordance with a first preferred embodiment of the present invention.
Figure 2:
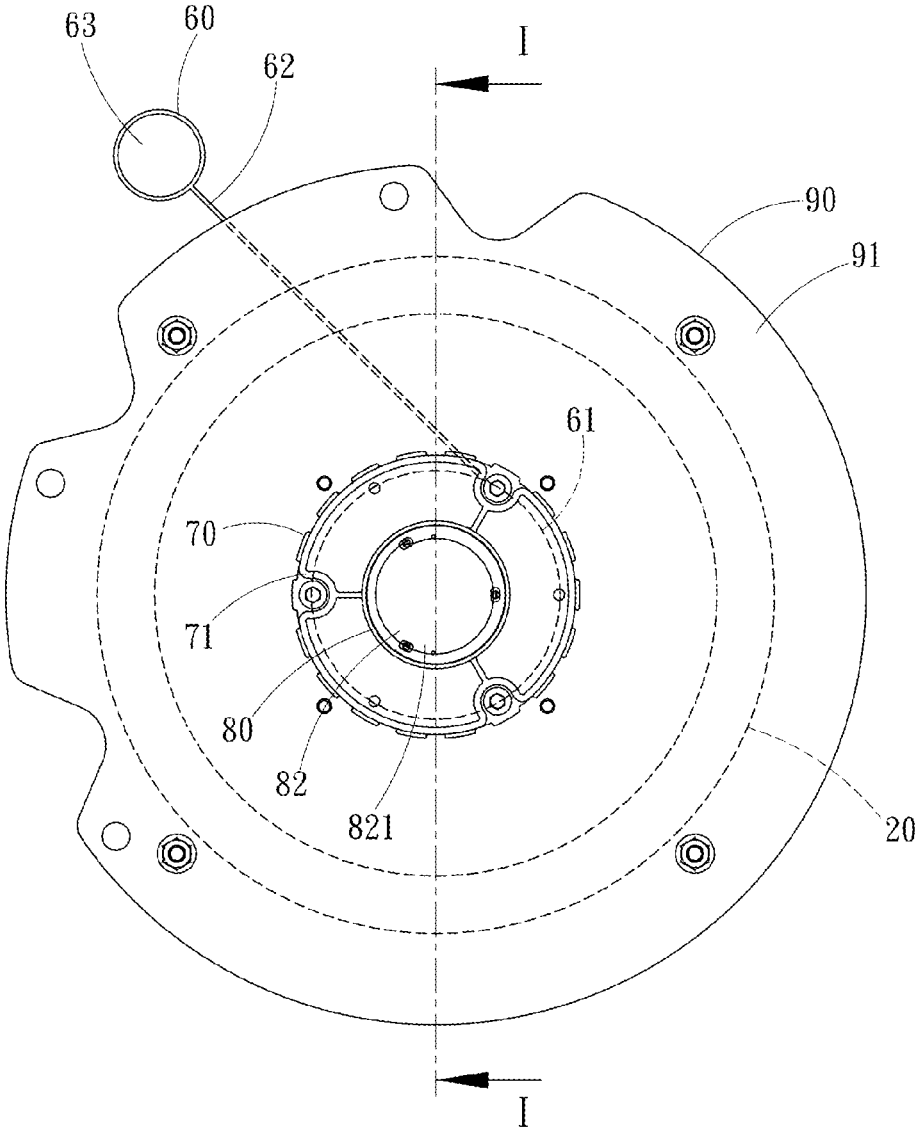
FIG. 2 is a side view of the reciprocating unidirectional electromagnetic resistance device of the present invention as depicted in FIG. 1.
Figure 3:
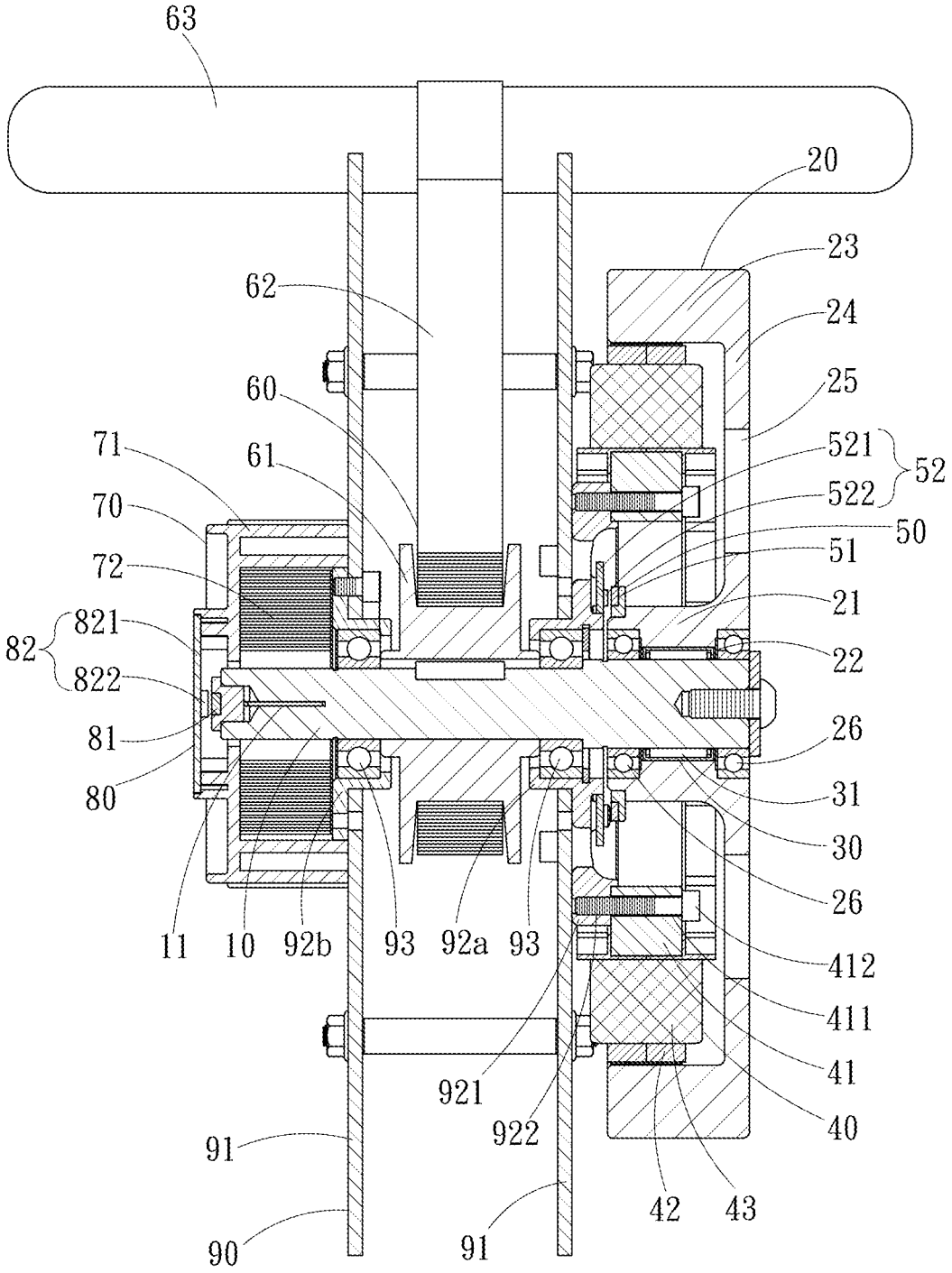
FIG. 3 is a cross-sectional view showing the Section I-I of the reciprocating unidirectional electromagnetic resistance device of the present invention as depicted in FIG. 2.

With reference to FIGS. 1, 2 and 3 for a reciprocating unidirectional electromagnetic resistance device in accordance with the first preferred embodiment of the present invention, the electromagnetic resistance device is applied to fitness equipment, and preferably comprises a shaft 10, a flywheel 20, a one-way clutch 30, an electromagnetic braking unit 40, a first sensing device 50, a pull rope device 60, a spring return device 70 and a second sensing device 80.

The shaft 10 is a round shaft, capable of further driving the flywheel 20 to rotate through the one-way clutch 30 when the shaft 10 is driven by the pull rope device 60 to rotate in a forward direction. In the meantime, the shaft 10 drives the spring return device 70 to perform an energy storage action (spring mechanical energy). When the operator releases the pull rope device 60, the energy released from the spring return device 70 can drive the shaft 10 and the pull rope device 60 to rotate in a reverse direction. The flywheel 20 is made of ferromagnetic material (such as iron), and the flywheel 20 comprises: a hub 21 having a shaft hole 22 at the axis of the hub 21, and passed through the shaft hole 22 and rotatably coupled to the shaft 10; an outer ring body 23, together with the hub 21 coaxially disposed around the periphery of the hub 21 to form a spacing for accommodating the electromagnetic braking unit 40; and a plurality of spokes 24, each coupled between the hub 21 and the outer ring body 23, and having a through hole 25 communicating both sides of each spoke 24, for improving the ventilation and cooling effects. Wherein, one or two ball bearings 26 can be installed into the hub 21 of the flywheel 20, and the ball bearings 26 are sheathed and fixed to the shaft 10, so that the flywheel 20 can be rotate on the shaft 10 through the ball bearings 26.

Figure 6:
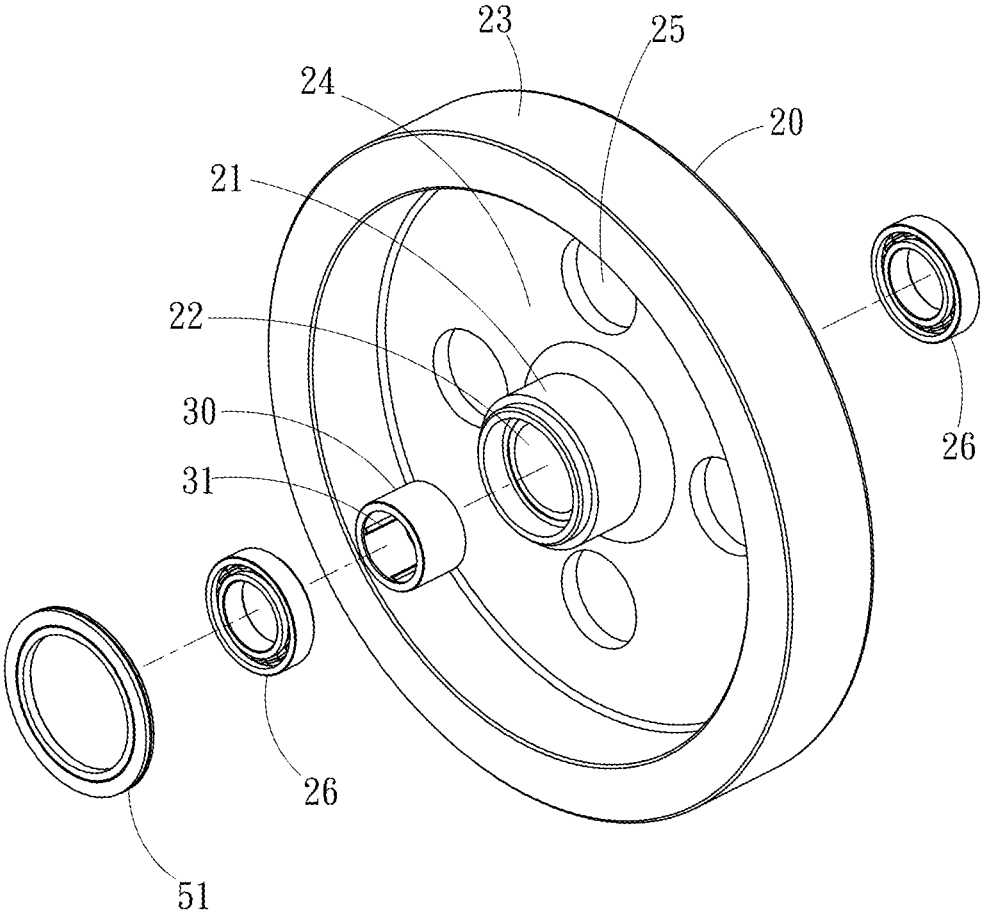
FIG. 6 is an exploded view of the flywheel and the one-way clutch of the present invention as depicted in FIG. 5.

The one-way clutch 30 is a component used for a one-way transmission through the internal roller 31. Depending on the type of the internal roller, a needle roller type one-way clutch, a wedge type one-way clutch, a cam type one-way clutch or any other clutch that can be used to make the shaft 10 to drive the flywheel 20 to rotate in a forward direction but not in a reverse direction. In a preferred embodiment, the one-way clutch 30 is in form of a socket (as shown in FIGS. 3 and 6), and has a roller 31 with an inner ring surface sheathed on a first end of the shaft 10, so that the roller 31 can be used to touch the circumferential surface of the shaft 10 to combine the shaft hole 22 of the hub 21 of the flywheel 20 with the outer ring surface of the one-way clutch 30 in a press fitting manner.

The electromagnetic braking unit 40 is an electromagnetic device used for generating a magnetic resistance to the flywheel 20. In a preferred embodiment, the electromagnetic braking unit 40 has a toroidal core 41, a plurality of serrated portions 42 formed on the outer ring of the toroidal core 41, and a plurality of coils 43 wound around the serrated portions 42 respectively. In this way, the electromagnetic braking unit 40 is installed disposed between the outer ring body 23 and the hub 21 of the flywheel 20 and coupled to an external controller (not shown in the figure) to control the current outputted to the coil 43 by the controller, so that the inner ring surface of the serrated portion 42 facing the outer ring body 23 can generate an electromagnetic resistance, and controlled current and the rotating speed of the outer ring body of the flywheel are specifically related to the electromagnetic resistance, so that the electromagnetic resistance and the load of the flywheel 20 can be changed and controlled accurately by the current of the coil and the detected rotating speed of the flywheel.

Figure 4:
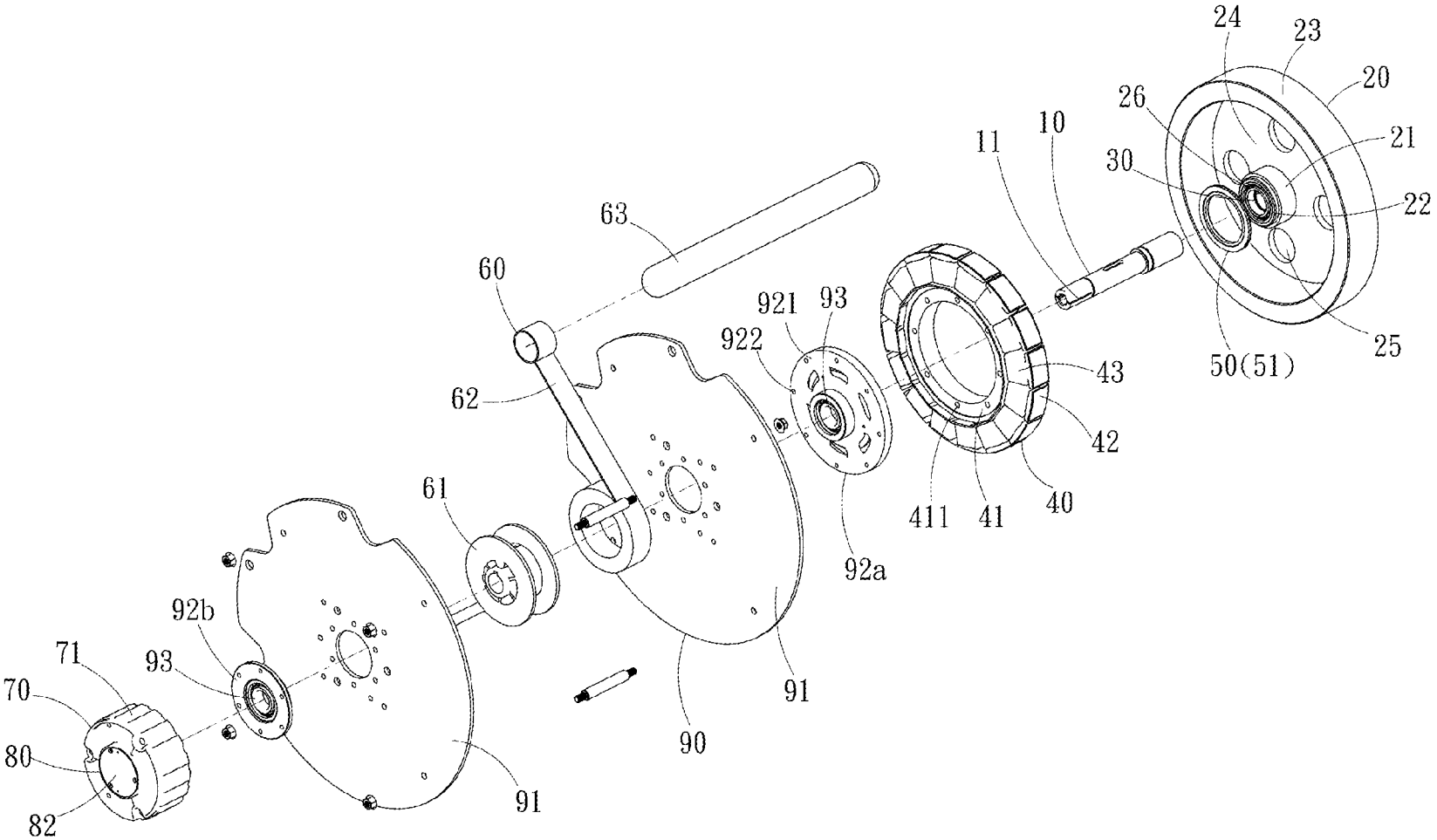
FIG. 4 is an exploded view of the reciprocating unidirectional electromagnetic resistance device of the present invention as depicted in FIG. 1 and viewing from a first angle.
Figure 5:
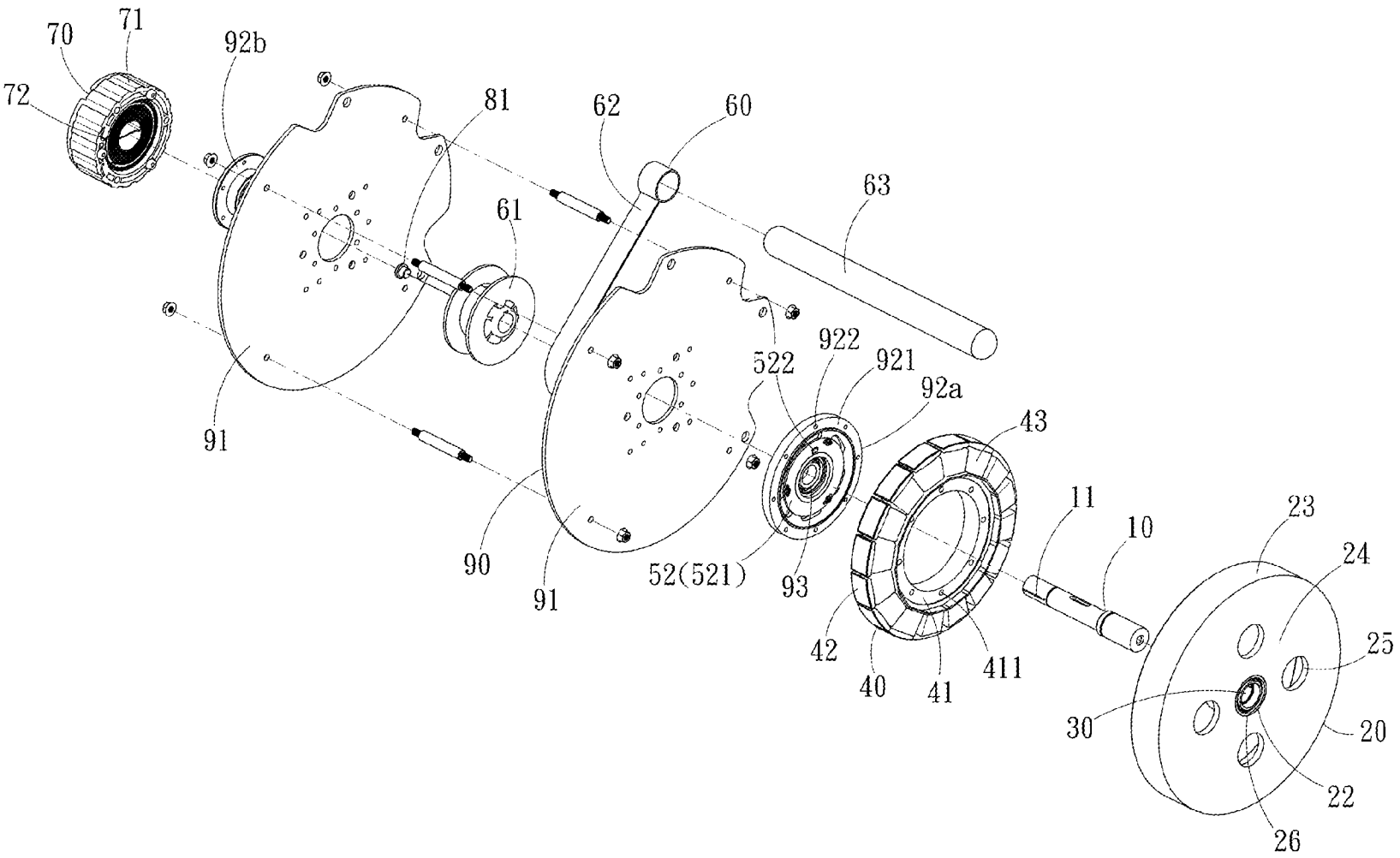
FIG. 5 is an exploded view of the reciprocating unidirectional electromagnetic resistance device of the present invention as depicted in FIG. 1 and viewing from a second angle.

With reference to FIGS. 3, 4, and 5, the first sensing device 50 is provided for sensing the rotating speed of the flywheel 20, and it preferably comprises a turntable 51 coupled to an end surface of the flywheel 20 and rotated synchronously with the flywheel 20; and a first sensing module 52, not rotated with the flywheel 20, but configured to be facing the turntable 51 for sensing the rotating speed of the disk turntable 51 and further feeding back a sensing signal to the controller, and then using the controller to control the current outputted to the electromagnetic braking unit 40, so as to control the load of the flywheel 20. Wherein, the first sensing device 50 can be a device with the magnetic induction, photoelectric or Hall effect, and a corresponding turntable 51 such as an encoding disk or a magnet ring may be implemented according to different sensing principles.

The pull rope device 60 is provided for an operator to directly or indirectly operate the device for a reciprocating motion. In a preferred embodiment, the pull rope device comprises a winding wheel 61 and a pull rope 62, and the winding wheel 61 is fixed to the shaft 10, and the pull rope 62 has an end coupled to the winding wheel 61 and the other end coupled to a grip 63 to allow the operator to directly apply a force for a pulling motion, or indirectly apply a force for a pulling motion on other mechanical parts connected to the fitness equipment in order to pull the winding wheel 61 and the shaft 10. In this way, when the operator directly or indirectly applies the force to the pull rope 62 for a centripetal contraction motion, the operator can pull the winding wheel 61 and the shaft 10 to rotate in a forward direction, and uses the shaft 10 and the one-way clutch 30 to drive the flywheel 20 to rotate unidirectionally. Since the flywheel 20 is exerted with a magnetic resistance of the electromagnetic braking unit 40 to create a load, therefore the operator can perform the centripetal contraction motion under the load status. On the other hand, when the operator release the pull rope 62, the spring return device 70 releases energy to drive the shaft 10 or the winding wheel 61 to retract the pull rope 62 in a reverse direction, and when the shaft 10 rotates in the reverse direction, the one-way clutch 30 can only perform the one-way transmission, but will not drive the flywheel 20 to rotate in the reverse direction.

The spring return device 70 is preferably a spring mechanical type energy storage device coupled to the shaft 10 or the winding wheel 61 for driving the spring return device 70 to store energy while the operator is performing the aforementioned centripetal contraction motion. On the other hand, when the operator release the centripetal contraction motion to allow the spring return device 70 to release the energy, the released energy drives the shaft 10 to rotate in a reverse direction and drive the winding wheel 61 to retract the pulled-out pull rope 62. The second sensing device 80 is a device for sensing the rotating speed of the shaft 10, and preferably coupled to the shaft 10 for sensing the rotating speed of the winding wheel 61 during rotation. By monitoring the rotating speed of the winding wheel and the size and parameters of the mechanical parts of the winding wheel, the invention can provide related exercise messages of a user's pulling speed through a controller or a console.

In FIGS. 3 to 5, the flywheel 20 is preferably installed to a first end of the shaft 10, and the spring return device 70 is installed to a second end of the shaft 10, and the winding wheel 61 of the pull rope device 60 is sheathed and fixed to the shaft 10 between the flywheel 20 and the spring return device 70 (which is the middle of the shaft 10, so as to achieve a better dynamic balance effect.

In FIGS. 3 to 5, a preferred embodiment of the present invention further comprises a bracket 90, and the bracket 90 preferably comprises two plates 91, and the shaft 10 is rotatably passed and disposed between the two plates 91, and both ends of the shaft 10 are protruded from both sides of the bracket 90, so that the flywheel 20, the electromagnetic braking unit 40 and the first sensing device 50 are disposed on the shaft 10 on a first side of the bracket 90, and the spring return device 70 and the second sensing device 80 are disposed on the shaft 10 on a second side of the bracket 90, and the pull rope device 60 is disposed on the shaft 10 between the two plates 91.

In an embodiment, the bracket 90 has two flanged bearing seats 92*a*, 92*b* and two ball bearings 93, and the two bearing seats 92*a*, 92*b* are coupled to the through holes of the two plates 91 respectively, and the two ball bearings 93 are installed into the bearing seats 92*a*, 92*b* respectively, and the shaft 10 is passed and installed to the two ball bearings 93. In a practical application, the bracket 90 can be assembled to the fitness exercise equipment, or the bracket 90 can be implemented as a part of the fitness equipment. In this way, the turntable 51 of the first sensing device 50 can be fixed on the hub 21 of the flywheel 20 (as shown in FIGS. 3, 4 and 6), and the first bearing seat 92*a* is disposed adjacent to one of the two bearing seats 92*a*, 92*b*, and the first sensing module 52 is implemented as a circuit board 521 and a sensing element 522 and fixed to an end of the first bearing seat 92*a* (as shown in FIGS. 3 and 5), so that the sensing element 522 faces the turntable 51 to carry out the sensing operation.

The first bearing seat 92*a* of one of the two bearing seats 92*a*, 92*b* has a flanged ring 921 and a plurality of screw holes 922 formed on the flanged ring 921; the toroidal core 41 of the electromagnetic braking unit 40 has a screw perforation 411 configured to be corresponsive to the screw hole 922 and passed through the respective screw perforation 411 and secured with a screw 412 in the screw hole 922, so that the toroidal core 41 can be detachably fixed to a side of the flanged ring 921. The present invention can change the electromagnetic braking unit 40 to a different magnetic resistance or replace the flywheel 20 with a different weight according to the type of fitness equipment used in the toroidal core 41 and the bearing seat 92*a* without the need of making any change to other components of the present invention.

In a preferred embodiment, the spring return device 70 comprises a shell 71 and a scroll spring 72, and an end of the shell 71 is coupled to an outer side of the plate 91 on the second side of the bracket 90, and the scroll spring 72 is installed in the shell 71 and wound around the shaft 10, so that an inner end of the scroll spring 72 is fixed to a notch 11 of the shaft 10, and an outer end of the scroll spring 72 is fixed to the shell 71. The second sensing device 80 preferably comprises a sensed element 81 and a second sensing module 82, and the sensed element 81 is fixed to an end surface of the shaft 10, and the second sensing module 82 is implemented as a circuit board 821 and a sensing element 822 and fixed to the shell 71, so that the sensing element 822 can face the sensed element 81 to sense the rotating speed of the shaft 10. The second sensing device 80 can also be of a magnetic induction type, a photoelectric type or a Hall effect type, and the corresponding sensed element 81 and second sensing module 82 can be implemented according to different sensing principles.

Figure 7:
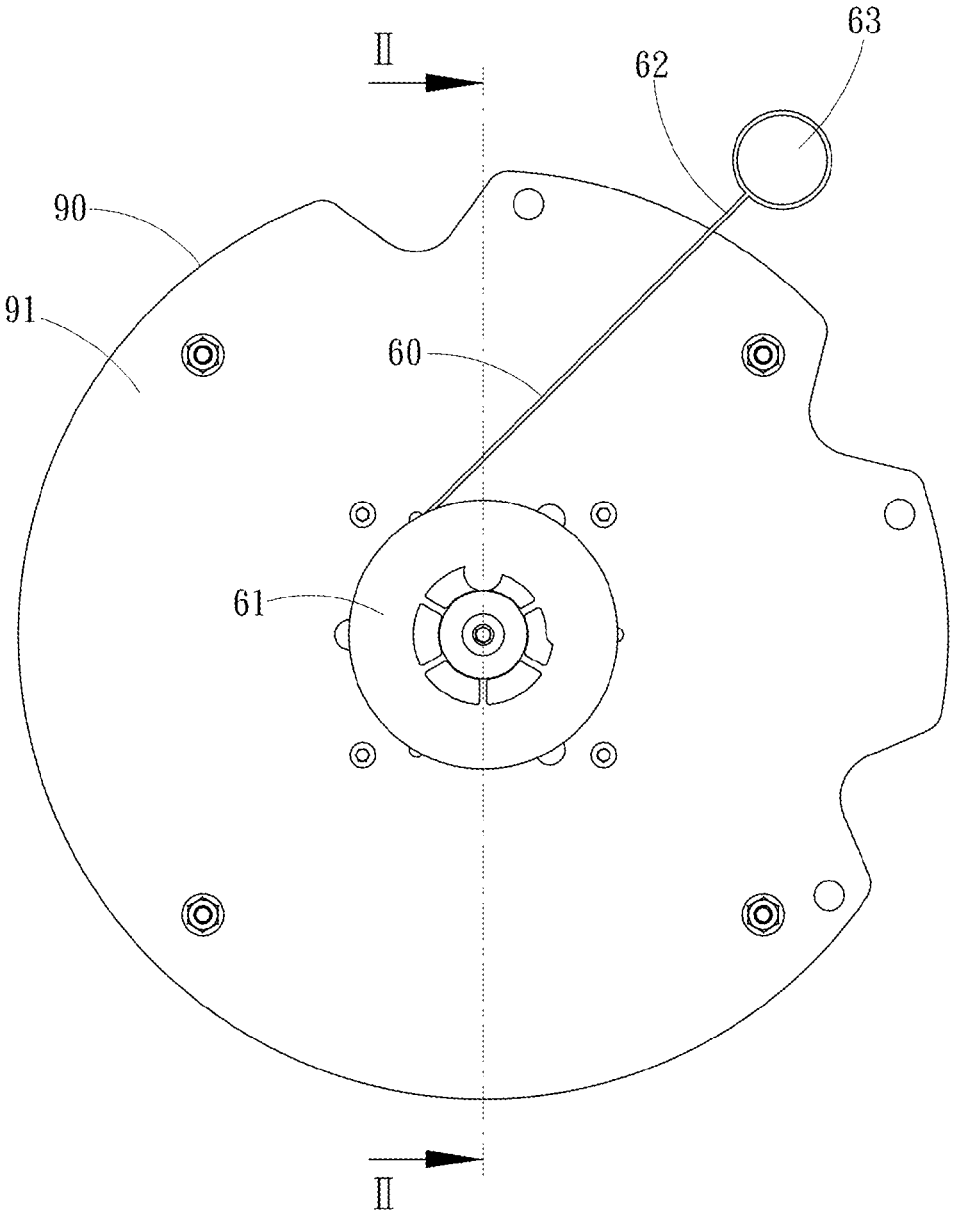
FIG. 7 is a side view of a reciprocating unidirectional electromagnetic resistance device in accordance with a second preferred embodiment of the present invention.
Figure 8:
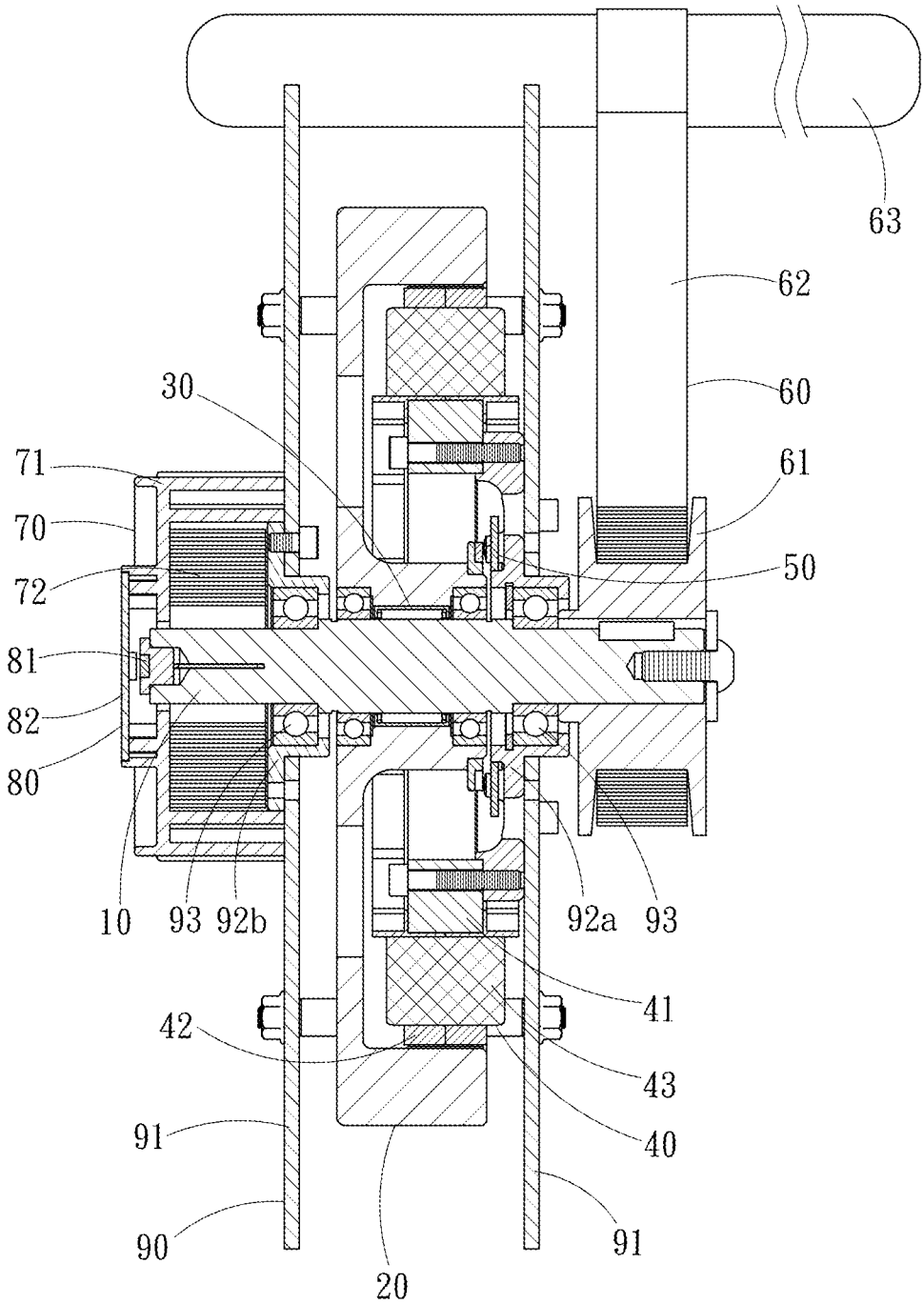
FIG. 8 is a cross-sectional view showing the Section II-II of the reciprocating unidirectional electromagnetic resistance device of the present invention as depicted in FIG. 7.

With reference to FIGS. 7 and 8 for the second preferred embodiment of the present invention, the winding wheel 61 of the pull rope device 60 is sheathed and fixed to the first end of the shaft 10, and the spring return device 70 is installed to the second end of the shaft 10, and the flywheel 20 is installed on the shaft 10 between the pull rope device 60 and the spring return device 70. Specifically, when the bracket 90 has two plates 91, the pull rope device 60 is installed to the first end of the shaft 10 on the first side of the bracket 90, and the spring return device 70 and the second sensing device 80 are disposed at the second end of the on the second side of the bracket 90, and the flywheel 20, the electromagnetic braking unit 40 and the first sensing device 50 are disposed on the shaft 10 between the two plates 91, so that the flywheel 20, the electromagnetic braking unit 40 and the first sensing device 50 are disposed at the middle of shaft 10 to achieve a better dynamic balance effect.

Figure 9:
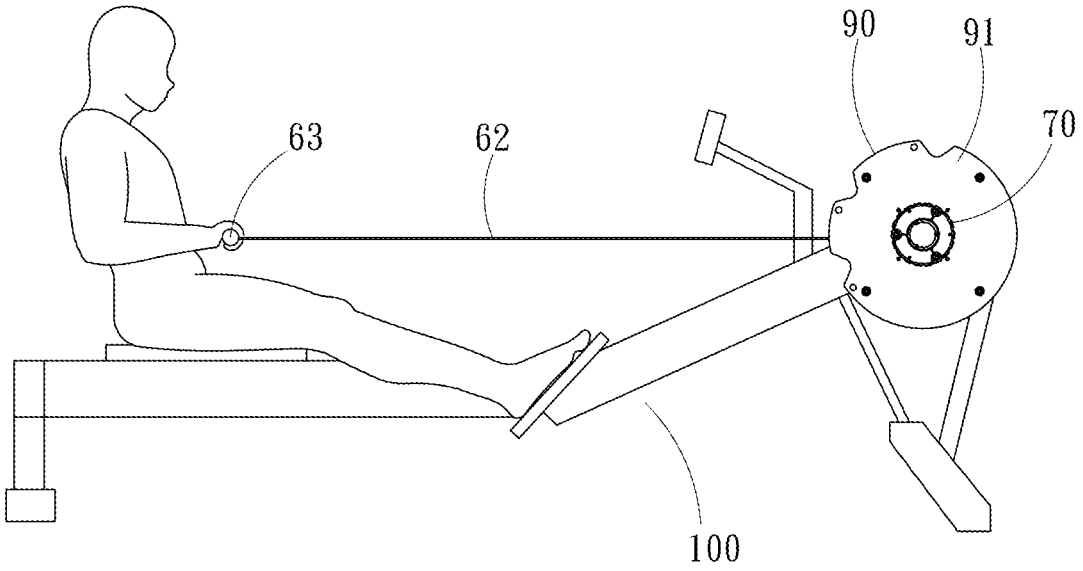
FIG. 9 is a schematic view of a reciprocating unidirectional electromagnetic resistance device applied to a rowing machine in accordance with the present invention.
Figure 10:
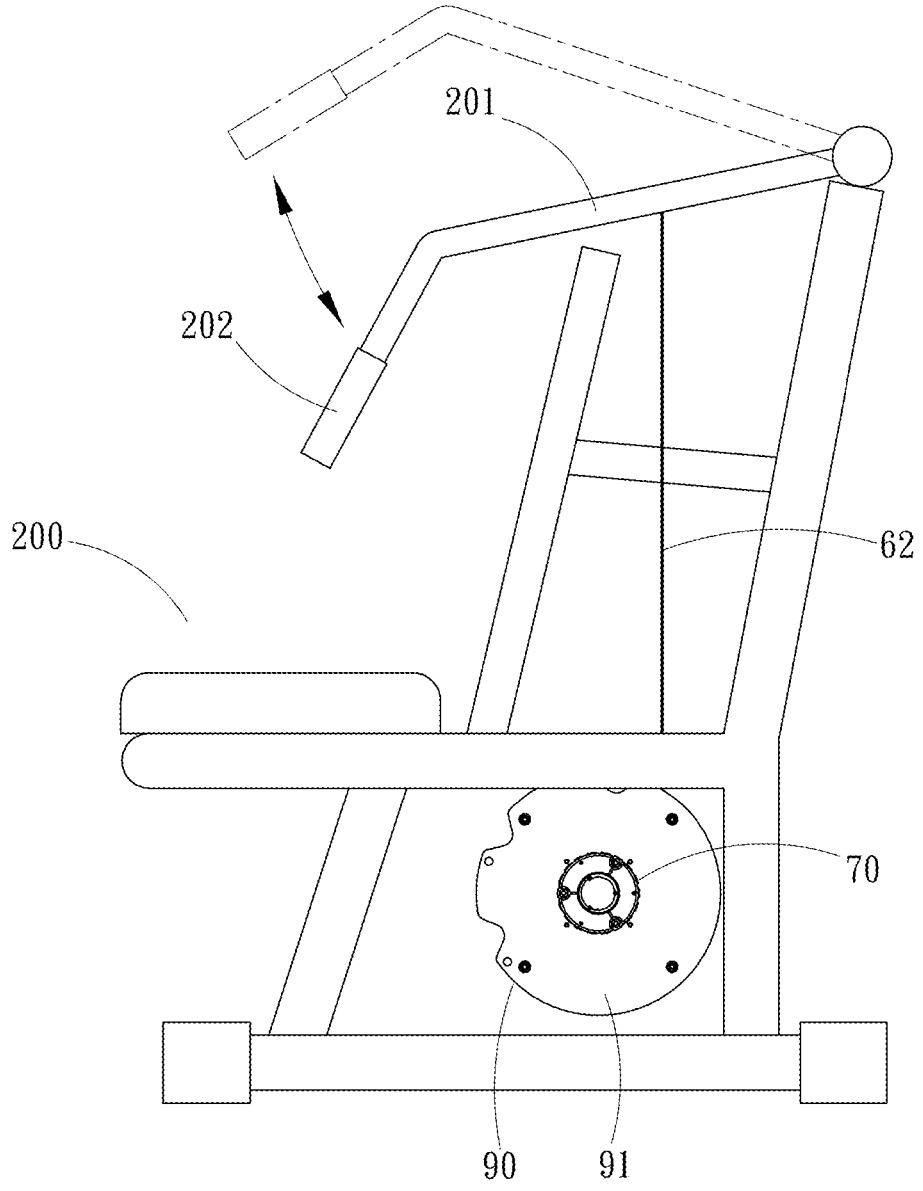
FIG. 10 is a schematic view of a reciprocating unidirectional electromagnetic resistance device applied to a chest push machine in accordance with the present invention.

When the invention is applied to fitness equipment as shown in FIG. 9, the invention can be used as a rowing machine 100, and the bracket 90 is fixed to the front end of the rowing machine 100, so that the operator can sit on the seat of the rowing machine 100 and use the hands to directly pull the grip 63 of the pull rope device 60 to perform the reciprocating centripetal contraction and centrifugal release. The training method is a prior art, and thus will not be repeated. In FIG. 10, the present invention can also be applied to a chest push machine 200, wherein the bracket 90 is fixed to an appropriate position of the chest push machine 200, and the pull rope 62 of the pull rope device 60 is coupled to the weighted lever 201 of the chest push machine 200, so that an operator can push the two grip levers 202 of the push machine 200 to perform the reciprocating training. Obviously, the invention can be widely used in other fitness equipment such as lat pulldown machines, butterfly machines, swim training machines, etc.

While the invention has been described by way of example and in terms of a preferred embodiment, it is to be understood that the invention is not limited thereto. To the contrary, it is intended to cover various modifications and similar arrangements and procedures, and the scope of the appended claims therefore should be accorded the broadest interpretation so as to encompass all such modifications and similar arrangements and procedures.

What is claimed is:

1. A reciprocating unidirectional electromagnetic resistance device, comprising:

a shaft;

a flywheel, having a hub rotatably coupled to the shaft, an outer ring body coaxially disposed around the hub; and a plurality of spokes, each spoke of the plurality of spokes being coupled between the hub and the outer ring body;

a one-way clutch, with an inner ring surface sheathed on the shaft, and the hub being sheathed and coupled to an outer ring surface of the one-way clutch;

an electromagnetic braking unit, having a toroidal core, a plurality of serrated portions formed at an outer ring of the toroidal core, and a plurality of coils wound around the serrated portions respectively, and the electromagnetic braking unit being installed between the hub and the outer ring body of the flywheel, and the serrated portion being configured to be facing an inner ring surface of the outer ring body to produce an electromagnetic resistance;

a pull rope device, having a winding wheel fixed to the shaft, and a pull rope with an end coupled to the winding wheel for pulling the winding wheel and the shaft, and the shaft and the one-way clutch driving the flywheel to rotate unidirectionally;

a spring return device, coupled to the shaft or the winding wheel, for driving the winding wheel to rewind the pulled-out pull rope, wherein the flywheel is installed at a first end of the shaft, and the spring return device is installed at a second end of the shaft, and the winding wheel of the pull rope device is sheathed and fixed between the flywheel and the spring return device;

a first sensing device, having a turntable coupled to an end surface of the flywheel and rotated synchronously with the flywheel, and a first sensing module configured to be facing the turntable to sense the rotating speed of the turntable;

a second sensing device coupled to the shaft for sensing the rotating speed of the winding wheel when the winding wheel is driven to rotate; and a bracket having two plates, and the shaft being rotatably passing into the two plates, so that both ends of the shaft are protruded from both sides of the bracket; and the flywheel, the electromagnetic braking unit and the first sensing device being disposed at the first end of the shaft on a first side of the bracket, and the spring return device and the second sensing device being disposed at the second end of the shaft on a second side of the bracket, and the pull rope device being disposed on the shaft between the two plates.

2. The reciprocating unidirectional electromagnetic resistance device according to claim 1, wherein the bracket has two bearing seats and two ball bearings, and the two bearing seats are coupled to two through holes of the two plates respectively, and the two ball bearings are disposed in the bearing seats respectively; and the shaft is passed and installed to the two ball bearings in the two bearing seats.

3. The reciprocating unidirectional electromagnetic resistance device according to claim 2, wherein the turntable of the first sensing device is fixed onto the hub of the flywheel and disposed adjacent to a first bearing seat of the two bearing seats, and the first sensing module is fixed onto the first bearing seat.

4. The reciprocating unidirectional electromagnetic resistance device according to claim 3, wherein the first bearing seat has a flanged ring with a plurality of screw holes; the toroidal core of the electromagnetic braking unit has a plurality of screw perforations configured to be corresponsive to the screw holes respectively, and a plurality of screws passed through the screw perforations and locked to the screw holes respectively, and the toroidal core is fixed to a side of the flanged ring.

5. A reciprocating unidirectional electromagnetic resistance device, comprising:

a shaft;

a flywheel, having a hub rotatably coupled to the shaft, an outer ring body coaxially disposed around the hub; and a plurality of spokes, each spoke of the plurality of spokes being coupled between the hub and the outer ring body;

a one-way clutch, with an inner ring surface sheathed on the shaft, and the hub being sheathed and coupled to an outer ring surface of the one-way clutch;

an electromagnetic braking unit, having a toroidal core, a plurality of serrated portions formed at an outer ring of the toroidal core, and a plurality of coils wound around the serrated portions respectively, and the electromagnetic braking unit being installed between the hub and the outer ring body of the flywheel, and the serrated portion being configured to be facing an inner ring surface of the outer ring body to produce an electromagnetic resistance;

a pull rope device, having a winding wheel fixed to the shaft, and a pull rope with an end coupled to the winding wheel for pulling the winding wheel and the shaft, and the shaft and the one-way clutch driving the flywheel to rotate unidirectionally;

a spring return device, coupled to the shaft or the winding wheel, for driving the winding wheel to rewind the pulled-out pull rope, wherein the winding wheel of the pull rope device is sheathed and fixed to a first end of the shaft, and the spring return device is installed to a second end of the shaft, and the flywheel is installed on the shaft between the pull rope device and the spring return device;

a first sensing device, having a turntable coupled to an end surface of the flywheel and rotated synchronously with the flywheel, and a first sensing module configured to be facing the turntable to sense the rotating speed of the turntable;

a second sensing device coupled to the shaft for sensing the rotating speed of the winding wheel when the winding wheel is driven to rotate; and a bracket having two plates, and the shaft rotatably passing through the two plates, so that both ends of the shaft are protruded from both sides of the bracket; and the pull rope device being installed to the first end of the shaft on a first side of the bracket, and the spring return device and the second sensing device being disposed at the second end of the shaft on a second side of the bracket, and the flywheel, the electromagnetic braking unit and the first sensing device being disposed on the shaft between the two plates.

6. The reciprocating unidirectional electromagnetic resistance device according to claim 5, wherein the bracket has two bearing seats and two ball bearings, and the two bearing seats are coupled to two through holes of the two plates respectively, and the two ball bearings are disposed in the bearing seats respectively; and the shaft is passed and installed to the two ball bearings in the two bearing seats.

7. The reciprocating unidirectional electromagnetic resistance device according to claim 6, wherein the turntable of the first sensing device is fixed onto the hub of the flywheel and disposed adjacent to a first bearing seat of the two bearing seats, and the first sensing module is fixed onto the first bearing seat.

8. The reciprocating unidirectional electromagnetic resistance device according to claim 7, wherein the first bearing seat has a flanged ring with a plurality of screw holes; the toroidal core of the electromagnetic braking unit has a plurality of screw perforations configured to be corresponsive to the screw holes respectively, and a plurality of screws passed through the screw perforations and locked to the screw holes respectively, and the toroidal core is fixed to a side of the flanged ring.

9. A reciprocating unidirectional electromagnetic resistance device, comprising:

a shaft;

a flywheel, having a hub rotatably coupled to the shaft, an outer ring body coaxially disposed around the hub; and a plurality of spokes, each spoke of the plurality of spokes being coupled between the hub and the outer ring body;

a one-way clutch, with an inner ring surface sheathed on the shaft, and the hub being sheathed and coupled to an outer ring surface of the one-way clutch;

an electromagnetic braking unit, having a toroidal core, a plurality of serrated portions formed at an outer ring of the toroidal core, and a plurality of coils wound around the serrated portions respectively, and the electromagnetic braking unit being installed between the hub and the outer ring body of the flywheel, and the serrated portion being configured to be facing an inner ring surface of the outer ring body to produce an electromagnetic resistance;

a pull rope device, having a winding wheel fixed to the shaft, and a pull rope with an end coupled to the winding wheel for pulling the winding wheel and the shaft, and the shaft and the one-way clutch driving the flywheel to rotate unidirectionally;

a spring return device, coupled to the shaft or the winding wheel, for driving the winding wheel to rewind the pulled-out pull rope, wherein the spring return device has a shell and a scroll spring installed in the shell and disposed around the shaft, and the scroll spring has an inner end fixed to the shaft and an outer end fixed to the shell;

a first sensing device, having a turntable coupled to an end surface of the flywheel and rotated synchronously with the flywheel, and a first sensing module configured to be facing the turntable to sense the rotating speed of the turntable;

a second sensing device coupled to the shaft for sensing the rotating speed of the winding wheel when the winding wheel is driven to rotate;

a sensed element fixed to an end surface of the shaft and a second sensing module fixed to the shell, and the second sensing module is configured to be facing the sensed element to sense the rotating speed of the sensed element and the shaft.

10. A reciprocating unidirectional electromagnetic resistance device, comprising:

a shaft;

a flywheel, having a hub rotatably coupled to the shaft, an outer ring body coaxially disposed around the hub, and a plurality of spokes, each spoke of the plurality of spokes being coupled between the hub and the outer ring body;

a one-way clutch, with an inner ring surface sheathed on the shaft, and the hub being sheathed and coupled to an outer ring surface of the one-way clutch;

an electromagnetic braking unit, having a toroidal core, a plurality of serrated portions formed at an outer ring of the toroidal core, and a plurality of coils wound around the serrated portions respectively, and the electromagnetic braking unit being installed between the hub and the outer ring body of the flywheel, and the serrated portion being configured to be facing an inner ring surface of the outer ring body to produce an electromagnetic resistance;

a pull rope device, having a winding wheel fixed to the shaft, and a pull rope with an end coupled to the winding wheel for pulling the winding wheel and the shaft, and the shaft and the one-way clutch driving the flywheel to rotate unidirectionally; and a spring return device, coupled to the shaft or the winding wheel, for driving the winding wheel to rewind the pulled-out pull rope;

a sensing device coupled to the shaft for sensing the rotating speed of the winding wheel when the winding wheel is driven to rotate; and a bracket having two plates, and the shaft being rotatably passing into the two plates, so that both ends of the shaft are protruded from both sides of the bracket; and the flywheel and the electromagnetic braking unit being disposed at a first end of the shaft on a first side of the bracket, and the spring return device and the sensing device being disposed at a second end of the shaft on a second side of the bracket, and the pull rope device being disposed on the shaft between the two plates.

11. The reciprocating unidirectional electromagnetic resistance device according to claim 10, wherein the sensing device comprises a sensed element and a sensing module, and the sensed element is fixed to an end surface of the shaft, and the sensing module is fixed to the spring return device, and the sensing module is configured to be facing the sensed element to sense the rotating speed of the sensed element and the shaft.

12. A reciprocating unidirectional electromagnetic resistance device, comprising:

a shaft;

a flywheel, having a hub rotatably coupled to the shaft, an outer ring body coaxially disposed around the hub; and a plurality of spokes, each spoke of the plurality of spokes being coupled between the hub and the outer ring body;

a one-way clutch, with an inner ring surface sheathed on the shaft, and the hub being sheathed and coupled to an outer ring surface of the one-way clutch;

an electromagnetic braking unit, having a toroidal core, a plurality of serrated portions formed at an outer ring of the toroidal core, and a plurality of coils wound around the serrated portions respectively, and the electromagnetic braking unit being installed between the hub and the outer ring body of the flywheel, and the serrated portion being configured to be facing an inner ring surface of the outer ring body to produce an electromagnetic resistance;

a pull rope device, having a winding wheel fixed to the shaft, and a pull rope with an end coupled to the winding wheel for pulling the winding wheel and the shaft, and the shaft and the one-way clutch driving the flywheel to rotate unidirectionally; and a spring return device, coupled to the shaft or the winding wheel, for driving the winding wheel to rewind the pulled-out pull rope;

a sensing device coupled to the shaft for sensing the rotating speed of the winding wheel when the winding wheel is driven to rotate; and a bracket having two plates, and the shaft rotatably passing through the two plates, so that both ends of the shaft are protruded from both sides of the bracket; and the pull rope device being installed to a first end of the shaft on a first side of the bracket, and the spring return device and the sensing device being disposed at a second end of the shaft on a second side of the bracket, and the flywheel and the electromagnetic braking unit being disposed on the shaft between the two plates.

13. The reciprocating unidirectional electromagnetic resistance device according to claim 12, wherein the sensing device comprises a sensed element and a sensing module, and the sensed element is fixed to an end surface of the shaft, and the sensing module is fixed to the spring return device, and the sensing module is configured to be facing the sensed element to sense the rotating speed of the sensed element and the shaft.

* * * * *